US008145074B2

(12) United States Patent
Kim et al.

(10) Patent No.: US 8,145,074 B2
(45) Date of Patent: Mar. 27, 2012

(54) METHOD OF CONTROLLING IMAGE FORMING APPARATUS USING WRITE PROTECTION

(75) Inventors: Chang-hwan Kim, Suwon-si (KR); Seung-deog An, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 815 days.

(21) Appl. No.: 11/489,524

(22) Filed: Jul. 20, 2006

(65) Prior Publication Data

US 2007/0019970 A1 Jan. 25, 2007

(30) Foreign Application Priority Data

Jul. 20, 2005 (KR) ..... 10-2005-0065778

(51) Int. Cl.
*G03G 15/00* (2006.01)

(52) U.S. Cl. ..... 399/12

(58) Field of Classification Search ..... 399/12, 399/24, 25

See application file for complete search history.

(56) References Cited

U.S. PATENT DOCUMENTS

| | | | | |
|---|---|---|---|---|
| 4,961,088 | A * | 10/1990 | Gilliland et al. | 399/25 |
| 6,295,423 | B1 * | 9/2001 | Haines et al. | 399/24 |
| 6,842,601 | B2 * | 1/2005 | Hosokawa | 399/301 |
| 6,975,816 | B2 * | 12/2005 | Ito et al. | 399/12 |
| 7,031,012 | B1 * | 4/2006 | Serizawa | 358/1.16 |
| 7,058,320 | B2 * | 6/2006 | Yamamoto et al. | 399/27 |
| 2002/0012541 | A1 * | 1/2002 | Takemoto et al. | 399/12 |
| 2002/0018657 | A1 | 2/2002 | Serizawa | |
| 2003/0228161 | A1 | 12/2003 | Chihara | |

FOREIGN PATENT DOCUMENTS

| | | |
|---|---|---|
| JP | 11-237816 | 8/1999 |
| JP | 2001-222193 | 8/2001 |
| KR | 1999-0011183 | 2/1999 |
| KR | 10-2001-0049000 A | 6/2001 |
| KR | 10-2003-0095291 A | 12/2003 |

* cited by examiner

*Primary Examiner* — David Gray
*Assistant Examiner* — Rodney Bonnette
(74) *Attorney, Agent, or Firm* — Roylance, Abrams, Berdo & Goodman, LLP

(57) ABSTRACT

A system and method are provided for controlling an image forming apparatus and include a supplies information storage unit, which is included in supplies of an image forming apparatus and which has a writable first storage area and a second storage area providing write protection, and which stores information regarding the supplies in the first storage area, a replacement time detecting unit, which detects a replacement time of the supplies and outputs the sensing result, and an information controller, which in response to the result output from the replacement time detecting unit, stores the information stored in the first storage area in the second storage area, sets the write protection, and deletes the information stored in the first storage area. Accordingly, illegally recycled supplies can be prevented from being installed or used. Thus, stability in the use of the image forming apparatus can be guaranteed, durability of the image forming apparatus can be lengthened, and printing quality deterioration can be prevented.

7 Claims, 3 Drawing Sheets

METHOD OF CONTROLLING IMAGE FORMING APPARATUS USING WRITE PROTECTION

CROSS-REFERENCE TO RELATED PATENT APPLICATION

This application claims the benefit under 35 U.S.C. §119 (a) of Korean Patent Application No. 10-2005-0065778, filed in the Korean Intellectual Property Office on Jul. 20, 2005, the entire disclosure of which is incorporated herein by reference.

BACKGROUND OF THE INVENTION

1. Field of the Invention

The present invention relates to image forming apparatuses such as printers, facsimiles, and multi-function products (MFPs). More particularly, the present invention relates to a system and method for controlling an image forming apparatus using a storage medium supporting write protection by being included in supplies for use with an image forming system.

2. Description of the Related Art

Accompanying an increase in the use of supplies used in image forming apparatuses, the number of users using cheaper recycled supplies is increasing relative to the number of users purchasing supplies corresponding to licensed products. Thus, the replacement of used supplies with cheaper recycled supplies is becoming more common.

When supplies legally recycled by companies authenticated by manufacturers or sellers of image forming apparatuses are used, complications rarely occur. However, if illegally recycled supplies having low quality are installed and used in image forming apparatuses, printing quality can decrease, the image forming apparatuses can be damaged, and the use of the image forming apparatuses can become dangerous.

Thus, one solution has been proposed wherein, when illegally recycled supplies are installed in conventional image forming apparatuses, the conventional image forming apparatuses sense the installation of the illegally recycled supplies and warn users of the use of the illegally recycled supplies by displaying the status via display devices. However, such conventional image forming apparatuses only make a user aware that illegally recycled supplies are installed in the conventional image forming apparatuses, and allow the apparatuses to operate even when the illegally recycled supplies are installed therein. There still exists a possibility that problems can be generated due to the use of the illegally recycled supplies.

Accordingly, a need exists for a system and method for detecting supply type usage, notifying a user of supply type usage, and controlling the apparatus in response to the detected supply type usage, for example, to prevent the use of illegally recycled supplies.

SUMMARY OF THE INVENTION

Embodiments of the present invention substantially solve the above and other problems, and provide a system and method for controlling an image forming apparatus using a storage medium supporting write protection by being included in supplies for use with an image forming system.

According to an aspect of embodiments of the present invention, an image forming system is provided comprising a supplies information storage unit, which is included in supplies of an image forming apparatus, and which comprises a writable first storage area and a second storage area providing write protection, and which stores information regarding the supplies in the first storage area, a replacement time detecting unit, which detects a replacement time of the supplies and outputs the sensing result, and an information controller, which in response to the result output from the replacement time detecting unit, stores the information stored in the first storage area in the second storage area, sets the write protection, and deletes the information stored in the first storage area.

The image forming system can further comprise a recycling determiner for determining whether the write protection is set for the second storage area and outputting the determination result, and an apparatus controller for controlling the image forming apparatus in response to the result output from the recycling determiner.

The apparatus controller can comprise a recycling authority determiner for determining whether supplies installed in the image forming apparatus are illegally recycled supplies in response to a result output from the recycling determiner that the write protection is set for the second storage area, and outputting the determination result.

The apparatus controller can further comprise an operation stoppage unit for controlling the image forming apparatus to stop operating in response to a result output from the recycling authority determiner that the supplies installed in the image forming apparatus are illegally recycled supplies.

The apparatus controller can further comprise a protection controller for controlling the image forming apparatus using variables that are pre-set to protect the image forming apparatus in response to a result output from the recycling authority determiner that the supplies installed in the image forming apparatus are legally recycled supplies.

The recycling authority determiner can determine whether the supplies installed in the image forming apparatus are illegally recycled supplies based on whether pre-set information is equal to the information stored in the first storage area.

The recycling authority determiner can also determine whether the supplies installed in the image forming apparatus are illegally recycled supplies based on whether information regarding a replacement time of the supplies has been initialized in the supplies information storage unit.

The determination by the recycling determiner as to whether the write protection is set for the second storage area can be performed at the time when the supplies are installed in the image forming apparatus.

According to another aspect of embodiments of the present invention, a storage medium is provided comprising a first storage area, which is writable and stores information regarding supplies, and a second storage area, which provides write protection and backup and storing functions for the information stored in the first storage area and setting the write protection thereto when a replacement time of the supplies is sensed, wherein the first storage area and the second storage area are included in the supplies.

According to another aspect of embodiments of the present invention, an image forming apparatus is provided comprising a replacement time detecting unit, which detects a replacement time of supplies and outputs the sensing result, and an information controller, which in response to the result output from the replacement time detecting unit, stores information stored in a first storage area in a second storage area, sets write protection, and deletes the information stored in the first storage area.

The image forming apparatus can further comprise a recycling determiner for determining whether the write protection is set for the second storage area and outputting the determination result, and an apparatus controller for controlling the image forming apparatus in response to the result output from the recycling determiner.

The apparatus controller can comprise a recycling authority determiner for determining whether supplies installed in the image forming apparatus are illegally recycled supplies in response to a result output from the recycling determiner that the write protection is set for the second storage area, and outputting the determination result.

The apparatus controller can further comprise an operation stoppage unit for controlling the image forming apparatus to stop operating in response to a result output from the recycling authority determiner that the supplies installed in the image forming apparatus are illegally recycled supplies.

The apparatus controller can further comprise a protection controller for controlling the image forming apparatus using variables that are pre-set to protect the image forming apparatus in response to a result output from the recycling authority determiner that the supplies installed in the image forming apparatus are legally recycled supplies.

The recycling authority determiner can determine whether the supplies installed in the image forming apparatus are illegally recycled supplies based on whether pre-set information is equal to the information stored in the first storage area.

The recycling authority determiner can also determine whether the supplies installed in the image forming apparatus are illegally recycled supplies based on whether information regarding a replacement time of the supplies has been initialized in a storage medium.

The determination by the recycling determiner as to whether the write protection is set for the second storage area can be performed at the time when the supplies are installed in the image forming apparatus.

According to another aspect of embodiments of the present invention, a method of controlling an image forming apparatus is provided, comprising detecting a replacement time of supplies and if the a replacement time of the supplies is sensed, storing information stored in a first storage area in a second storage area, setting write protection, and deleting the information stored in the first storage area.

The method can further comprise determining whether the write protection is set for the second storage area and controlling the image forming apparatus in response to the result determined in the determination step.

The controlling step can comprise determining whether supplies installed in the image forming apparatus are illegally recycled supplies if it is determined in the determination step that the write protection is set for the second storage area.

The controlling step can further comprise stopping an operation of the image forming apparatus if it is determined in the determination step that the supplies installed in the image forming apparatus are illegally recycled supplies.

The controlling step can still further comprise controlling the image forming apparatus using variables that are pre-set to protect the image forming apparatus if it is determined in the determination step that the supplies installed in the image forming apparatus are legally recycled supplies.

In the determination step, it can be determined whether the supplies installed in the image forming apparatus are illegally recycled supplies based on whether pre-set information is equal to the information stored in the first storage area.

In the determination step, it can also be determined whether the supplies installed in the image forming apparatus are illegally recycled supplies based on whether information regarding a replacement time of the supplies has been initialized in a storage medium.

In the determination step, a determination as to whether the write protection is set for the second storage area can be performed at the time when the supplies are installed in the image forming apparatus.

According to another aspect of embodiments of the present invention, a computer readable recording medium having recorded thereon a computer readable program for performing the method can be provided.

BRIEF DESCRIPTION OF THE DRAWINGS

The above and other features and advantages of embodiments of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF THE EXEMPLARY EMBODIMENTS

A method of controlling an image forming apparatus and an image forming system according to the present invention will now be described more fully with reference to the accompanying drawings, in which exemplary embodiments of the present invention are shown.

Figure 1:
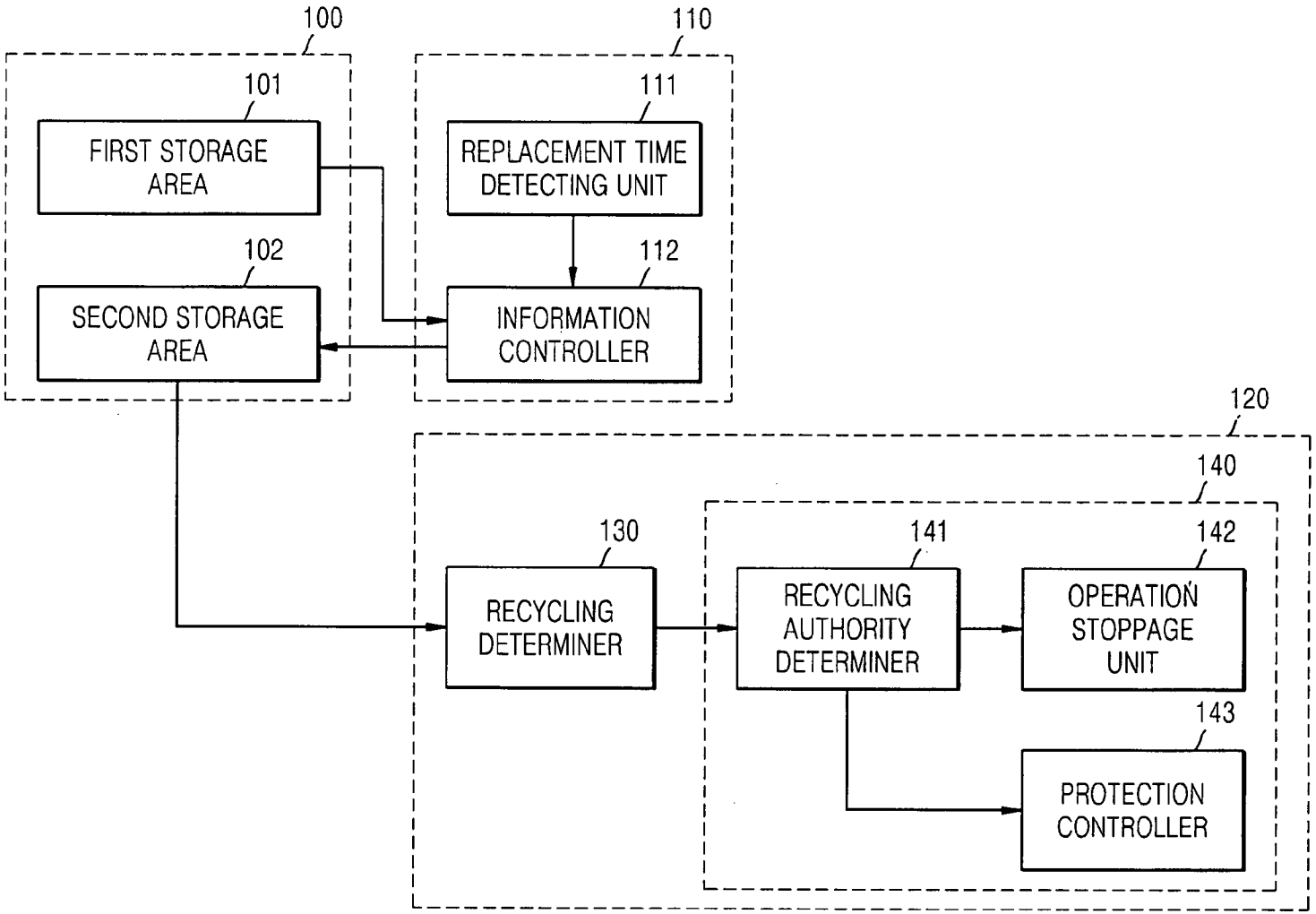
FIG. 1 is a block diagram of an exemplary image forming system according to an embodiment of the present invention.

FIG. 1 is a block diagram of an exemplary image forming system according to an embodiment of the present invention. The image forming system comprises a supplies information storage unit 100, a storage medium controller 110, and a controller 120.

Supplies comprise devices, materials, accessories, and so forth, that are required to operate image forming apparatuses, such as cartridges and intermediate transfer belts, whose replacement time is limited, and which can be replaced because they are attachable to/detachable from the image forming apparatuses. Supplies can often be recycled such as through the replenishment of toner, and the recycling of supplies can be classified as legal recycling in which the supplies are recycled by companies authorized by manufacturers or agents of image forming apparatuses, and illegal recycling in which the supplies are recycled by unauthorized companies. The terms 'legal' and 'illegal' are used herein to denote sources of recycling (e.g., authorized and unauthorized sources, respectively), and do not particularly denote or imply noncompliance with or violation of any laws, statutes or restrictions.

The supplies information storage unit 100 can be included in supplies of an image forming apparatus and stores information regarding the supplies. Here, for example, information regarding supplies denotes information required for an operation of the supplies such as a manufacturer identity (ID), model name, manufacturing date, product serial number, manufacturing and management number, toner capacity, operational environment, replacement time, and a present usage status such as the number of printed sheets and/or the number of printed dots.

The supplies information storage unit 100 comprises a first storage area 101 and a second storage area 102.

The first storage area 101 can be writable and/or rewritable, and stores the information regarding supplies.

The second storage area 102 provides write protection, and when a replacement time of the supplies is sensed, the second storage area 102 can be used to backup and store the information stored in the first storage area 101 and set the write protection thereto according to a control of an information controller 112. Here, the write protection can be a function for preventing stored data from being overwritten.

When the replacement time of the supplies is sensed, the storage medium controller 110 can be used to backup and store the information stored in the first storage area 101 in the second storage area 102 and set the write protection for the second storage area 102.

The storage medium controller 110 comprises a replacement time detecting unit 111 and the information controller 112.

The replacement time detecting unit 111 detects a replacement time of supplies and outputs the sensing result to the information controller 112. Here, for example, the replacement time detecting unit 111 detects the replacement time by counting the number of printed dots or sensing an ink level, and comparing the counted or sensed result to a pre-set threshold.

The information controller 112, in response to the result output from the replacement time detecting unit 111, stores the information stored in the first storage area 101 in the second storage area 102, sets the write protection, and deletes the information stored in the first storage area 101.

The controller 120 controls the image forming apparatus according to the information stored in the first storage area 101 and/or the second storage area 102 of the supplies information storage unit 100.

The controller 120 comprises a recycling determiner 130 and an apparatus controller 140.

The recycling determiner 130 determines whether the write protection is set for the second storage area 102 and outputs the determination result to a recycling authority determiner 141. Here, it is preferable that the determination by the recycling determiner 130 as to whether the write protection is set for the second storage area 102 is performed at the time when supplies are reinstalled in the image forming apparatus after supplies are uninstalled from the image forming apparatus. If the recycling determiner 130 determines that the write protection is set for the second storage area 102, it is then determined that the supplies installed in the image forming apparatus are recycled supplies that are not licensed.

The apparatus controller 140 controls the image forming apparatus to operate in response to the result output from the recycling determiner 130.

The apparatus controller 140 comprises the recycling authority determiner 141, an operation stoppage unit 142, and a protection controller 143.

In response to the determination result that the write protection is set for the second storage area 102, the recycling authority determiner 141 determines whether supplies installed in the image forming apparatus are illegally recycled supplies and outputs its determination result to the operation stoppage unit 142 or the protection controller 143. Here, if the recycling authority determiner 141 determines that the supplies installed in the image forming apparatus are legally recycled supplies, the recycling authority determiner 141 outputs the determination result to the protection controller 143, and if the recycling authority determiner 141 determines that the supplies installed in the image forming apparatus are illegally recycled supplies, the recycling authority determiner 141 outputs the determination result to the operation stoppage unit 142.

The recycling authority determiner 141 determines whether the supplies installed in the image forming apparatus are illegally recycled supplies by comparison of pre-set information, such as a manufacturer ID, product serial number, manufacturing and management number, or certification number, to the information stored in the first storage area 101 or by a determination of whether information regarding a replacement time of the supplies is initialized.

The operation stoppage unit 142 controls the image forming apparatus to stop the operation in response to the determination result that the supplies installed in the image forming apparatus are illegally recycled supplies. The operation stoppage unit 142 informs a user that illegally recycled supplies are installed in the image forming apparatus by providing a display through a liquid crystal display (LCD) panel included in the image forming apparatus or through a dialog box provided by an operating system (OS), e.g., Windows, of a host device.

The protection controller 143, in response to the determination result that the supplies installed in the image forming apparatus are legally recycled supplies, controls the image forming apparatus using variables pre-set to stably operate and protect the apparatus, rather than controlling the image forming apparatus to produce a print with high image quality.

Figure 2:
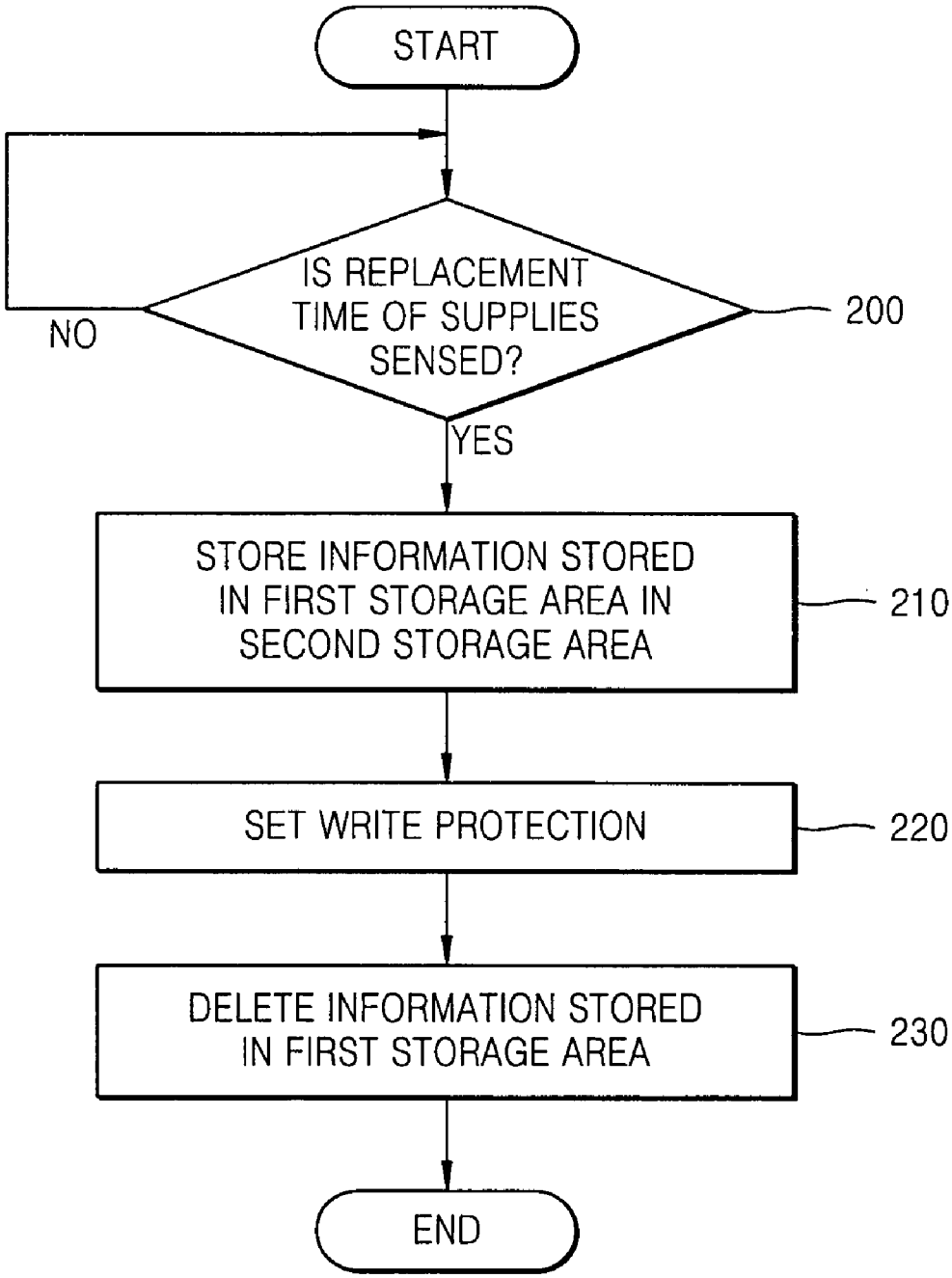
FIG. 2 is a flowchart illustrating an exemplary method of controlling an image forming apparatus according to an embodiment of the present invention.

FIG. 2 is a flowchart illustrating an exemplary method of controlling an image forming apparatus according to an embodiment of the present invention.

In regard to the exemplary method of FIG. 2, a storage medium is included in usable supplies and comprises a writable first storage area and a second storage area providing write protection, and stores information regarding the supplies in the first storage area.

Referring to FIG. 2, in operation 200, a replacement time of the supplies is sensed.

If the replacement time of the supplies is sensed, the second storage area performs backup and storage of the information stored in the first storage area in operation 210. That is, the information stored in the first storage area is stored in the second storage area.

In operation 220, write protection is set for the information stored in the second storage area.

In operation 230, the information stored in the first storage area is deleted.

Figure 3:
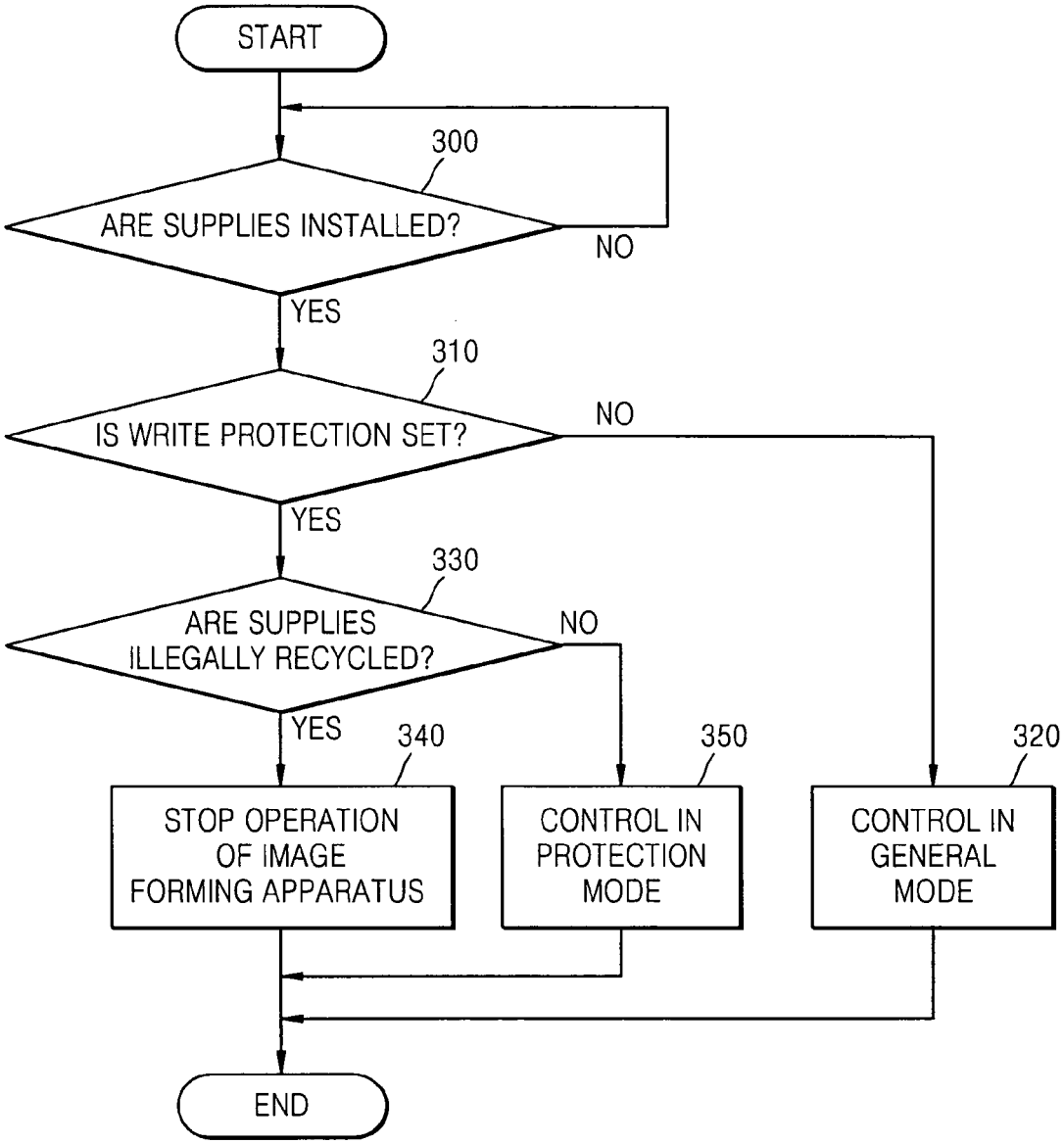
FIG. 3 is a flowchart illustrating an exemplary method of controlling an image forming apparatus according to another embodiment of the present invention.

FIG. 3 is a flowchart illustrating an exemplary method of controlling an image forming apparatus according to another embodiment of the present invention.

The method of FIG. 3 relates to an image forming apparatus in which supplies having a storage medium are installed, the storage medium comprising a writable first storage area and a second storage area providing write protection, and storing information regarding the supplies in the first storage area.

Referring to FIG. 3, in operation 300, the system is monitored to determine whether supplies are reinstalled in the image forming apparatus after supplies are uninstalled from the apparatus.

If it is sensed in operation 300 that supplies are reinstalled in the image forming apparatus, it is determined whether write protection is set for the second storage area in operation 310.

If it is determined in operation 310 that write protection is not set for the second storage area, the image forming apparatus is controlled in a general mode in operation 320. In the general mode, the image forming apparatus is controlled using variables that are optimally pre-set to produce a print with high image quality to equal results obtained with supplies corresponding to licensed products.

If it is determined in operation 310 that write protection is set for the second storage area, it is determined whether the supplies installed in the image forming apparatus are illegally recycled supplies in operation 330. It can be determined whether the supplies installed in the image forming apparatus are illegally recycled supplies by comparison of pre-set information, such as a manufacturer ID, product serial number, manufacturing and management number, or certification number, to the information stored in the first storage area or by a determination of whether information regarding a replacement time of the supplies is initialized in the storage medium.

If it is determined in operation 330 that the supplies installed in the image forming apparatus are legally recycled supplies, the image forming apparatus is controlled in a protection mode in operation 350. In the protection mode, the image forming apparatus is controlled using variables that are pre-set so that the image forming apparatus is stably operated and protected.

If it is determined in operation 330 that the supplies installed in the image forming apparatus are illegally recycled supplies, the operation of the image forming apparatus is stopped in operation 340, and a user is informed that illegally recycled supplies are installed in the image forming apparatus by providing a display through an LCD panel included in the image forming apparatus or through a dialog box provided by an OS, e.g., Windows, of a host device.

Exemplary embodiments of the present invention can also be written as computer programs and can be implemented in general-use digital computers that execute the programs using a computer-readable recording medium. Examples of the computer readable recording medium comprise magnetic storage media (e.g., ROM, floppy disks, hard disks, etc.), optical recording media (e.g., CD-ROMs, or DVDs), and other storage media.

As described above, in a system and method for controlling an image forming apparatus according to embodiments of the present invention, the image forming apparatus can be controlled using a storage medium supporting write protection by being included in supplies.

Accordingly, illegally recycled supplies can be prevented from being used. Thus, stability in the use of the image forming apparatus can be guaranteed, durability of the image forming apparatus can be lengthened, and printing quality deterioration can be prevented.

While the present invention has been particularly shown and described with reference to exemplary embodiments thereof, it will be understood by those skilled in the art that various changes in form and detail may be made therein without departing from the spirit and scope of the present invention as defined by the following claims and their equivalents.

What is claimed is:

1. An image forming system comprising:

a main body of an image forming apparatus;

a toner cartridge removably mounted in the main body of the image forming apparatus, the toner cartridge having a cartridge housing for containing toner and including an information storage unit attached to an exterior surface of the cartridge housing, the information storage unit having a non-write protectable memory area and a write protectable memory area, wherein a write protection set to the write protectable memory area serves as an indication that the toner cartridge is a recycled product; and a controller provided at the main body of the image forming apparatus, the controller configured to determine if the toner cartridge is a recycled product based on whether a write protection is set to the write protectable memory area and to determine that the toner cartridge is recycled without authorization based on information stored in the non-write protectable memory area.

2. The system of claim 1, wherein the controller controls the image forming apparatus according to determination of whether the toner cartridge is a recycled product.

3. The system of claim 2, wherein the controller further comprises:

an operation stoppage unit for controlling the image forming apparatus to stop operating in response to determination that the toner cartridge installed in the image forming apparatus is recycled without authorization.

4. The system of claim 2, wherein the controller further comprises:

a protection controller for controlling the image forming apparatus using variables that are pre-set to protect the image forming apparatus in response to determination that the toner cartridge installed in the image forming apparatus is recycled with authorization.

5. The system of claim 2, wherein the recycling authority determiner is configured to determine whether the toner cartridge installed in the image forming apparatus is recycled without an authorization, based on whether pre-set information is equal to the information stored in the non-write protectable memory area.

6. The system of claim 2, wherein the recycling authority determiner is configured to determine whether the toner cartridge installed in the image forming apparatus is recycled without authorization, based on whether information regarding a replacement time of the toner cartridge has been initialized in the information storage unit.

7. The system of claim 2, wherein the controller determining whether the write protection is set for the write protectable memory area is performed when the toner cartridge is installed in the image forming apparatus.

* * * * *